US005969481A

United States Patent [19]

Konopka

[11] Patent Number: 5,969,481

[45] Date of Patent: Oct. 19, 1999

[54] POWER SUPPLY AND ELECTRONIC BALLAST WITH HIGH EFFICIENCY VOLTAGE CONVERTER

[75] Inventor: John G. Konopka, Barrington, Ill.

[73] Assignee: Motorola Inc., Schaumburg, Ill.

[21] Appl. No.: 08/941,140

[22] Filed: Sep. 30, 1997

[51] Int. Cl.[6] ..... H05B 37/02

[52] U.S. Cl. ..... 315/209 R; 315/219; 315/246; 315/283

[58] Field of Search ..... 315/209 R, 246, 315/283, 205, 219

[56] References Cited

U.S. PATENT DOCUMENTS

| | | | |
|---|---|---|---|
| 3,943,428 | 3/1976 | Whidden | 321/15 |
| 4,268,899 | 5/1981 | Rokas | 363/61 |
| 4,272,704 | 6/1981 | Alexander | 315/205 |
| 4,445,166 | 4/1984 | Berglund et al. | 363/48 |
| 4,809,152 | 2/1989 | Bingham et al. | 363/61 |
| 5,113,337 | 5/1992 | Steigerwald | 363/98 |
| 5,119,282 | 6/1992 | Steigerwald et al. | 363/37 |
| 5,148,087 | 9/1992 | Moisin et al. | 315/291 |
| 5,627,455 | 5/1997 | Jacobs et al. | 323/222 |
| 5,694,006 | 12/1997 | Konopka | 315/219 |

*Primary Examiner*—Don Wong
*Assistant Examiner*—Jennifer H. Malos
*Attorney, Agent, or Firm*—Kenneth D. Labudda; Gary J. Cunningham

[57] ABSTRACT

An electronic power supply (10) comprising a rectifier circuit (100) and a voltage converter circuit (200). Voltage converter circuit (200) comprises a first inductor (220), a second inductor (230), an electronic switch (240), a control circuit (300), a first rectifier (250), a second rectifier (260), a first capacitor (270), and a second capacitor (280). First inductor (220) and second inductor (230) may be implemented either as separate inductors or as coupled inductors. Power supply (10) efficiently provides a high output voltage with greater efficiency than conventional boost converters.

21 Claims, 6 Drawing Sheets

POWER SUPPLY AND ELECTRONIC BALLAST WITH HIGH EFFICIENCY VOLTAGE CONVERTER

FIELD OF THE INVENTION

The present invention relates to the general subject of electronic power supplies and, in particular, to a power supply and electronic ballast with a high efficiency voltage converter.

BACKGROUND OF THE INVENTION

Many types of AC power supplies, such as electronic ballasts for fluorescent lamps, include a boost converter for providing operational benefits such as power factor correction and line regulation. In theory, a boost converter can provide an output voltage that is many times greater than the input voltage. However, in actual boost converters, output voltages of greater than about twice the peak input voltage are highly impractical because the peak currents and power dissipation in certain components (particularly in the boost inductor and the boost switch) become prohibitively high under such conditions.

In certain applications, it is often desirable to have a boost output voltage that is on the order of at least two to three times the peak of the AC line voltage. One such application is in electronic ballasts that include a boost converter followed by a high frequency inverter. Because the boost output voltage serves as the input voltage to the inverter, and since the amount of dissipative current that flows in the inverter can be reduced by increasing the inverter input voltage, a higher boost output voltage tends to enhance inverter efficiency. Unfortunately, a higher boost output voltage may at the same time degrade the efficiency of the boost converter.

"Voltage doubler" circuits have been used for quite some time to provide a DC output voltage equal to twice the peak value of the AC line voltage. Conventional voltage doubler circuits are structurally simple and energy efficient, but are incapable of providing the high degree of power factor correction that is usually required in many types of power supplies and electronic ballasts.

A number of attempts have been made in the prior art to fulfill the need for a power factor correcting converter that efficiently provides high voltage gain. In particular, several inventors have developed "boost voltage doubler" circuits that combine the power factor correction advantages of a boost converter with the efficiency and high voltage gain of a voltage doubler. Examples of such circuits are described in U.S. Pat. Nos. 5,383,109 and 5,502,630. Unfortunately, existing boost voltage doubler circuits have the significant disadvantage of requiring at least two power transistor switches. Consequently, the control circuit for turning the transistor switches on and off is quite extensive. Thus, the prior art circuits tend to be rather complicated and costly and are therefore unattractive for use in power supplies and ballasts for which low material cost and ease of manufacture are important requirements.

It is thus apparent that a need exists for a voltage converter that efficiently provides high voltage gain along with a high degree of power factor correction, and that has a structure that is considerably less complex and expensive than existing circuits. Such a circuit would constitute a significant improvement over the prior art.

DETAILED DESCRIPTION OF THE PREFERRED EMBODIMENTS

Figure 1:
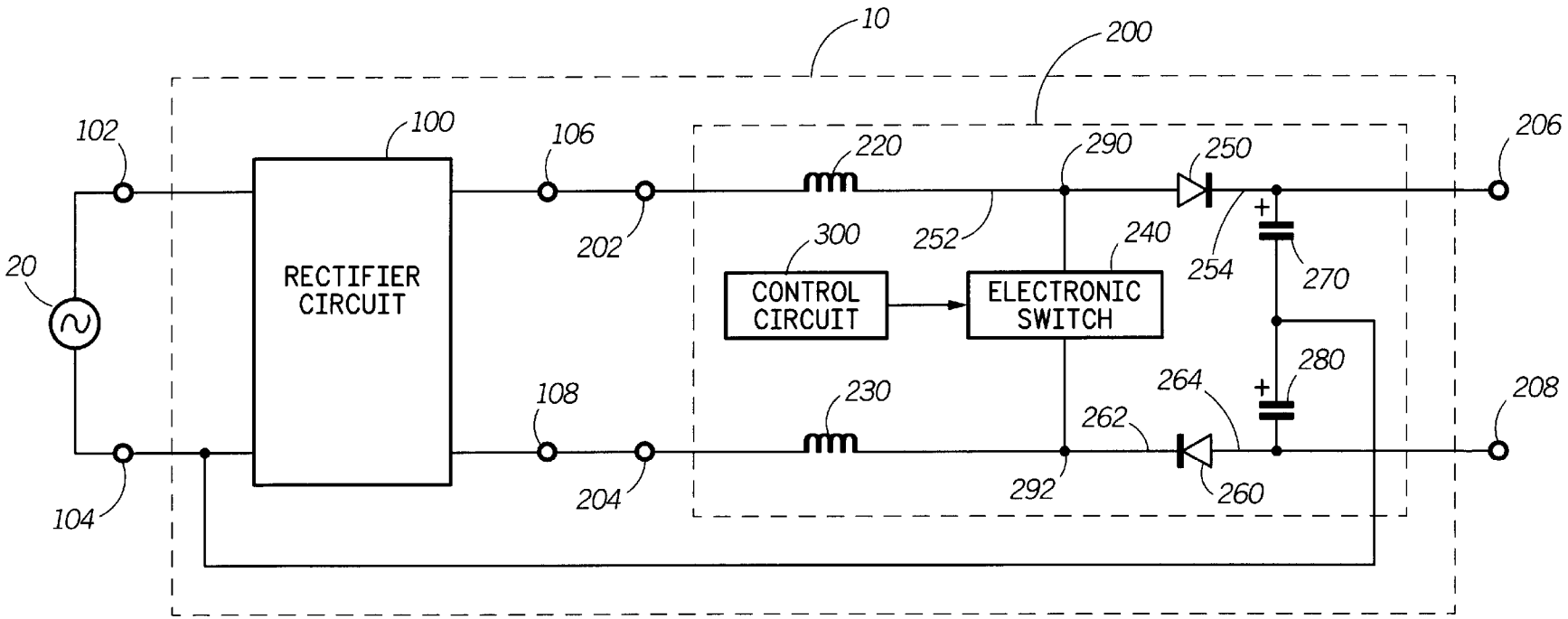
FIG. 1 is a schematic diagram of a power supply with a high efficiency voltage converter, in accordance with the present invention.

An electronic power supply 10 comprising a rectifier circuit 100 and a voltage converter circuit 200 is described in FIG. 1. Rectifier circuit 100 includes a pair of input connections 102,104 adapted to receive a source of alternating current 20, and a pair of output connections 106,108. Voltage converter circuit 200 includes first and second input terminals 202,204 coupled to output connections 106,108 of rectifier circuit 100, and first and second output terminals 206,208.

As described in FIG. 1, voltage converter circuit 200 includes a first inductor 220, a second inductor 230, an electronic switch 240, a control circuit 300, a first rectifier 250, a second rectifier 260, a first capacitor 270, and a second capacitor 280. First inductor 220 is coupled between first input terminal 202 and a first node 290. Electronic switch 240, which may be realized using a power transistor or any of a number of controllable power switching devices, is coupled between first node 290 and a second node 292. Control circuit 300 is coupled to electronic switch 240. Second inductor 230 is coupled between second node 292 and second input terminal 204. First rectifier 250 has an anode 252 coupled to first node 290, and a cathode 254 coupled to first output terminal 206. Second rectifier 260 has a cathode 262 coupled to second node 292, and an anode 264 coupled to second output terminal 208. First capacitor 270 is coupled between first output terminal 206 and a third node 296. Second capacitor 280 is coupled between third node 296 and second output terminal 208. Finally, third node 296 is coupled to one of the input connections 102,104 of rectifier circuit 100. In FIG. 1, third node 296 is shown coupled to input connection 104. However, third node 296 may just as well be coupled to input connection 102 without affecting or detracting from the desired operation of power supply 10.

Power supply 10 efficiently provides a high level of voltage gain, but has a structure that is significantly simpler and more cost-effective than that of existing circuits. Since power supply 10 requires only a single electronic switch 240, control circuit 300 may be implemented using a conventional current-mode or power factor correction type controller.

Figure 2:
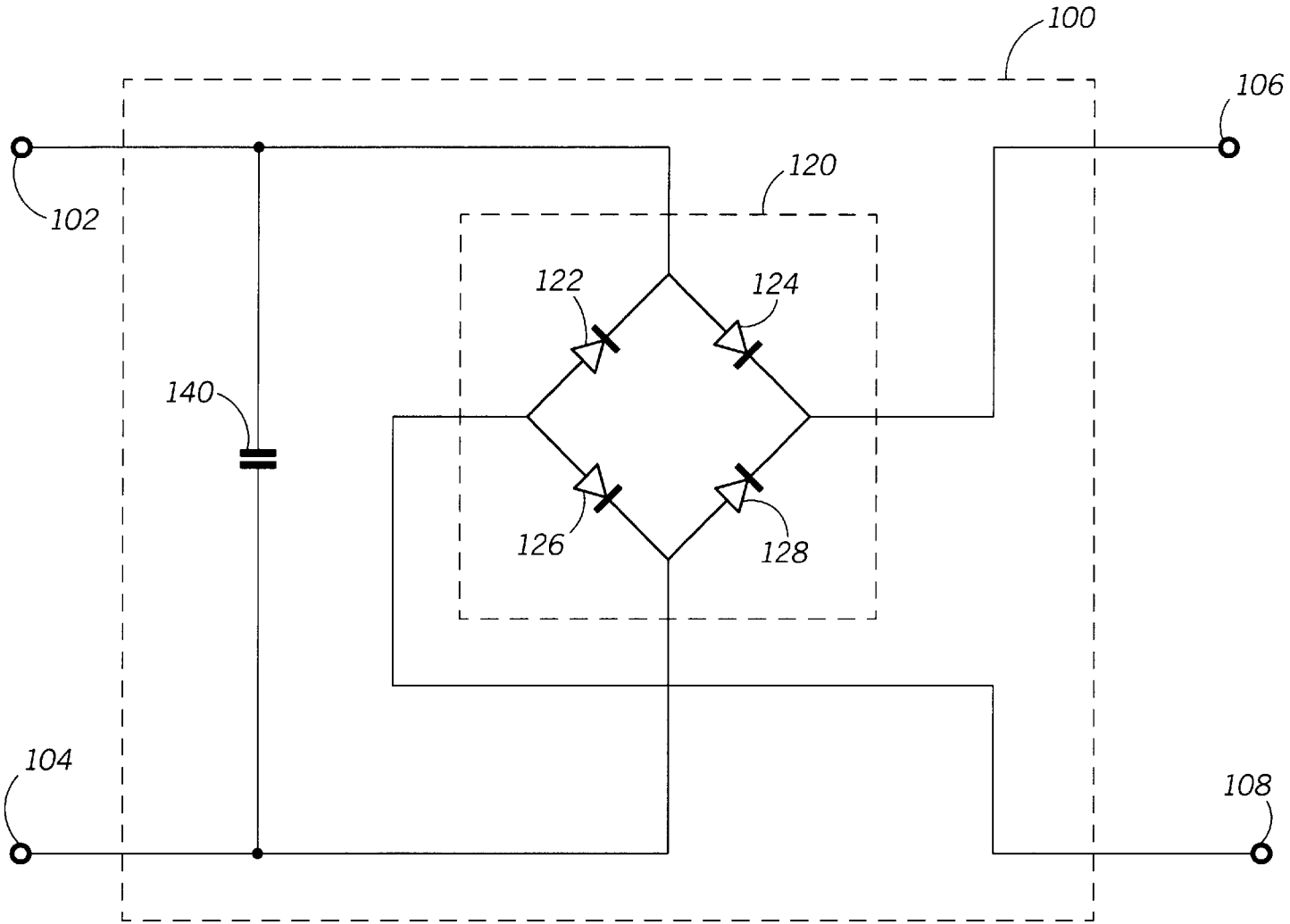
FIG. 2 is a schematic diagram of a rectifier circuit suitable for use in the power supply of FIG. 1, in accordance with a preferred embodiment of the present invention.

As illustrated in FIG. 2, rectifier circuit 100 preferably includes a full-wave diode bridge 120 coupled between input connections 102,104 and output connections 106,108, and comprising bridge diodes 122,124,126,128. Rectifier circuit further includes a high frequency bypass capacitor 140 coupled between input connections 102,104. Capacitor 140 supplies the high frequency current drawn during operation of voltage converter 200. The energy drawn out of capacitor 140 by voltage converter 200 is replenished by low frequency (e.g., 60 Hertz) current from AC source 20. Additionally, capacitor 140 provides a low impedance circuit path for high frequency current that flows in the feedback path from third node 296 to input terminal 104. Capacitor 140 thus contributes substantially to power factor correction by reducing or substantially eliminating any flow of high frequency current out of, or into, AC source 20.

Figure 3:
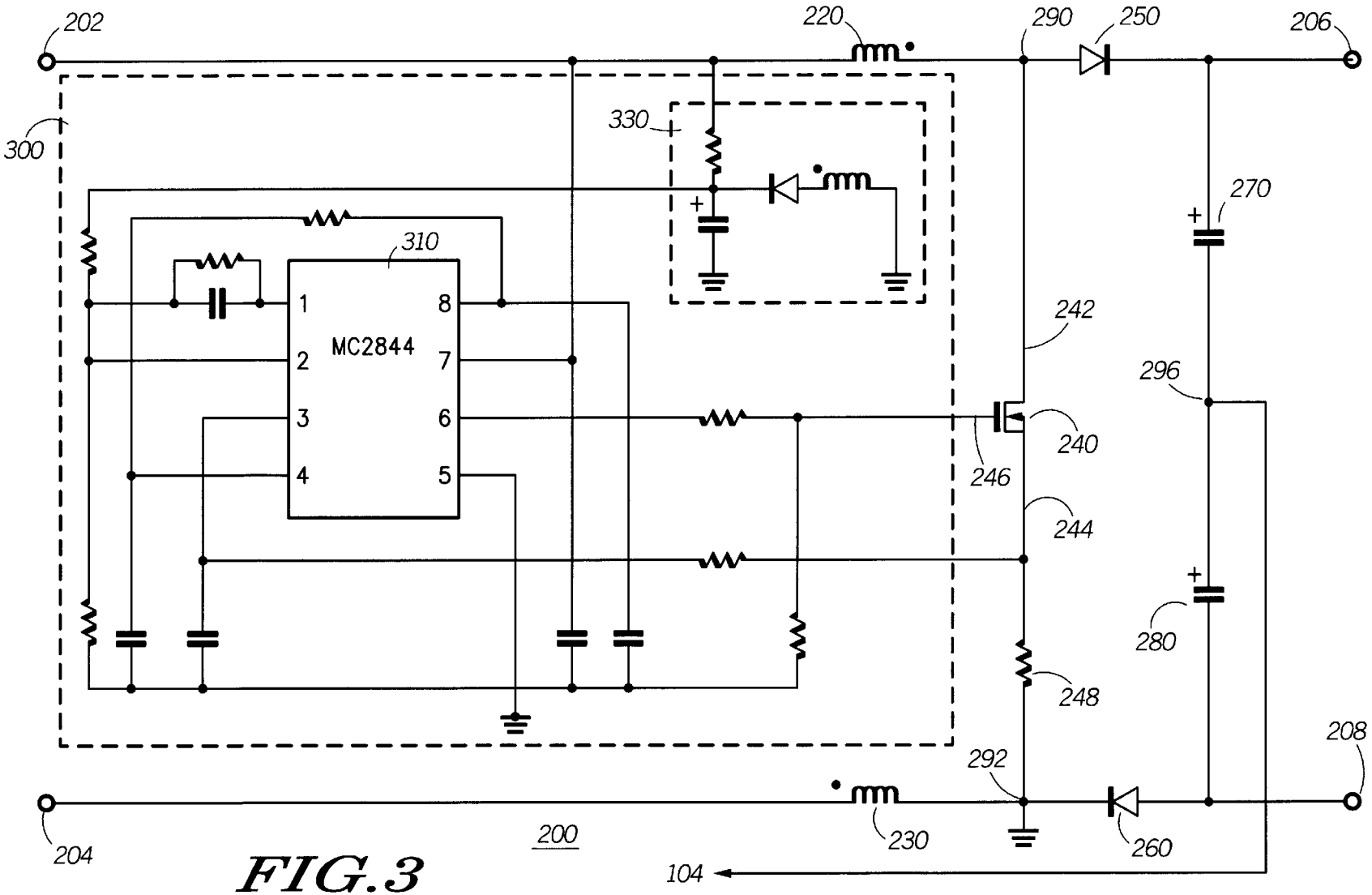
FIG. 3 is a schematic diagram of a high efficiency voltage converter with a current-mode control circuit, in accordance with a preferred embodiment of the present invention.

Turning now to FIG. 3, in a preferred embodiment of voltage converter 200, electronic switch 240 is preferably implemented as a field-effect transistor (FET) 240 having a drain lead 242 coupled to first node 290, a source lead 244 coupled to second node 292 via a current-sensing resistor 248, and a gate lead 246 coupled to control circuit 300. Control circuit 300, which switches FET 240 on and off at a high frequency rate preferably in excess of 20,000 Hertz, may be implemented using any of a number of suitable circuits known to those skilled in the art of boost converters and switchmode power supplies. In order to provide a high level of power factor correction, control circuit 300 preferably comprises either a current-mode type controller, such as the MC2844 integrated circuit manufactured by Motorola, Inc., or a power factor correction (PFC) type controller, such as the MC33262 integrated circuit manufactured by Motorola, Inc. As shown in FIG. 3, control circuit 300 comprises a current-mode controller IC 310 and associated peripheral circuitry, including an auxiliary circuit 330 that supplies IC 310 with operating power and a feedback signal representative of the output voltage of voltage converter 200. Various details pertaining to the operation of control circuit 300 and current-mode controller IC 310 are well known to those skilled in the art of switching converters. A control circuit substantially similar to control circuit 300 is described in greater detail in U.S. Pat. No. 5,148,087, the disclosure of which is incorporated herein by reference.

Inductors 220,230 may be realized either as separate components (i.e., each inductor having its own bobbin and core) or as an integrated magnetic assembly wherein first inductor 220 is magnetically coupled to second inductor 230. In either case, the inductances of first inductor 220 and second inductor 230 are preferably chosen to be approximately equal. This promotes balanced operation wherein the voltage and current stresses on inductors 220,230 are substantially equal. In the latter case, first inductor 220 and second inductor 230 share a common magnetic core and preferably have an equal number of wire turns. Additionally, first inductor 220 and second inductor 230 are preferably oriented in relation to each other (i.e., dot convention) such that the presence of a positive voltage across first inductor 220 from first input terminal 202 to first node 290 substantially coincides with the presence of a positive voltage across second inductor 230 from second node 292 to second input terminal 204.

It is further preferred that capacitors 270,280, which are typically implemented using electrolytic capacitors, have equal capacitance values and voltage ratings, thus allowing the average output voltage to be approximately equally distributed between the two capacitors.

The detailed operation of power supply 10 when implemented using separate inductors is now explained with reference to FIG. 4 as follows. For the sake of clarity, an example is considered in which the output voltage of voltage converter 200 is set at 450 volts (dc). To further simplify explanation, AC source 20 is assumed to be a conventional 120 volt (rms) AC line source, and circuit operation is considered during the positive and negative peaks of the AC line source, during which times the voltage across capacitor 140 is at its peak value of approximately 170 volts.

During the positive half-cycles of AC source 20, bridge diodes 124,126 are forward-biased, while bridge diodes 122,128 are reverse-biased (see FIG. 2). Turning now to FIG. 4(*a*), with the FET turned on, a positive current flows out of capacitor 140 through diode 124, first inductor 220, the FET (not explicitly shown, but depicted as an effective short circuit), second inductor 230, diode 126, and back into capacitor 140. During this period, diodes 250,260 are reverse biased and thus preclude any charging of capacitors 270,280 while the FET is on. The currents 11,12 through inductors 220,230 are equal (assuming, of course, that inductors 220,230 have the same inductance) and ramp up in a substantially linear fashion. Thus, while the FET is on, energy is stored in inductors 220,230.

Figure 4:
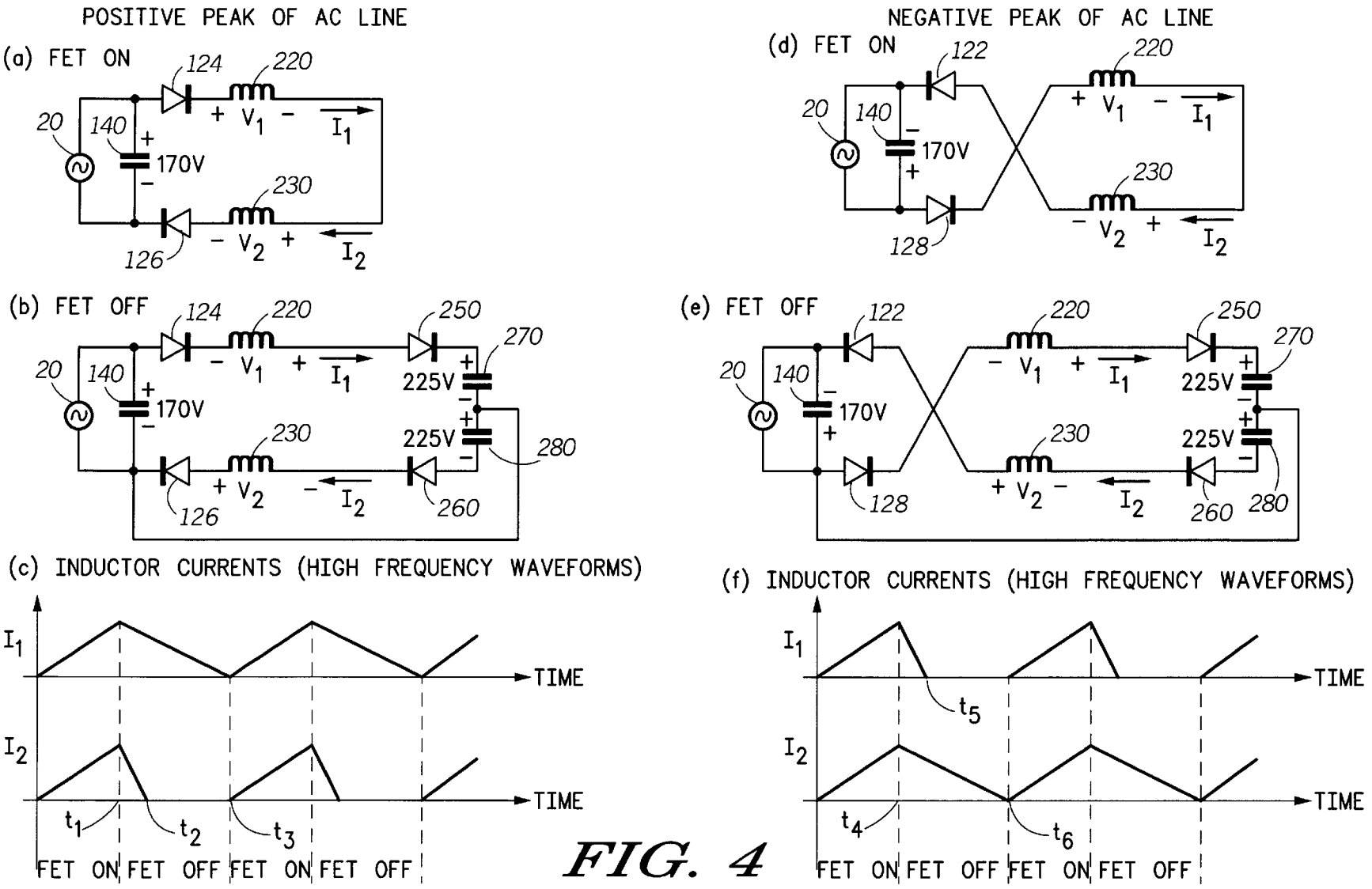
FIG. 4 illustrates equivalent circuits and approximate inductor current waveforms for the power supply of FIG. 2 when implemented with two separate inductors, in accordance with a preferred embodiment of the present invention.

Turning now to FIG. 4(*b*), when the FET is turned off at $t=t_1$, diodes 250,260 become forward biased and the stored energy in inductors 220,230 is transferred into capacitors 270,280. Specifically, $I_1$ flows out of first inductor 220 through diode 250, capacitor 270, capacitor 140, diode 124, and back into first inductor 220. Capacitor 140 provides a low-impedance circuit path for $I_1$ and thus prevents an otherwise substantial amount of high frequency current from flowing back into AC source 20. $I_2$ flows out of second inductor 230 through diode 126, capacitor 280, diode 260, and back into second inductor 230. Thus, the stored energy in first inductor 220 is transferred into capacitor 270, while the stored energy in second inductor 230 is transferred into capacitor 280.

As shown in FIG. 4(*c*), with the FET off, the currents $I_1$,$I_2$ decrease in an approximately linear fashion. However, since the voltages $V_1$,$V_2$ across each inductor are not equal, the currents $I_1$,$I_2$ decrease at different rates. More specifically, when the FET is turned off, $V_1$ is equal to the difference between the voltage across capacitor 270 and the voltage across capacitor 140, while $V_2$ is equal to the voltage across capacitor 280. Therefore, using the example values shown, $V_1$ goes to 225−170 =55 volts, while $V_2$ goes to 225 volts. Thus, because of the higher voltage across second inductor 230, $I_2$ decreases more rapidly than $I_1$.

$I_2$ continues to decrease until it reaches zero at $t=t_2$. At this point, the stored energy in second inductor 230 is completely depleted, having been transferred into capacitor 280, and diode 260 ceases to conduct. However, as 11 has not yet reached zero, the remaining energy in first inductor 220 continues to be transferred into capacitor 270 until $I_1$ likewise reaches zero at $t=t_3$.

The aforementioned events are then repeated during the next switching cycle, which may begin either coincident with $I_1$ reaching zero (i.e., "critical conduction mode operation", as shown in FIG. 4(*c*)) or some time before or after $I_1$ reaches zero. The mode of switching operation in this regard is a matter of design choice dependent upon several parameters involving AC source 20, control circuit 300, and the amount of power provided at the output of voltage converter 200.

During the negative half-cycles of AC source 20, bridge diodes 122,128 are forward-biased, while bridge diodes 124,126 are reverse-biased (see FIG. 2). Referring now to FIG. 4(*d*), with the FET turned on, a positive current flows out of capacitor 140 through diode 128, first inductor 220, the FET (not explicitly shown, but depicted as an effective short circuit), second inductor 230, diode 122, and back into capacitor 140. During this period, diodes 250,260 are reverse biased and thus preclude any charging of capacitors 270,280 while the FET is on. The currents $I_1$,$I_2$ through inductors 220,230 are equal during this time (assuming that inductors 220,230 have the same inductance) and ramp up in a substantially linear fashion, as shown in FIG. 4(*f*).

Referring now to FIGS. 4(*e*) and 4(*f*), when the FET is turned off at $t=t_4$, diodes 250,260 become forward biased and the energy previously stored in inductors 220,230 is then transferred into capacitors 270,280. As shown in FIG. 4(*f*), the currents $I_1$,$I_2$ decrease in an approximately linear fashion. However, since the voltages $V_1$,$V_2$ across each inductor are not equal, the currents $I_1$,$I_2$ decrease at different rates. More specifically, using the example values shown, when the FET is turned off, the voltage $V_1$ across first inductor 220 goes to 225 volts, while the voltage $V_2$ across second inductor 230 goes to 225−170 =55 volts. As a consequence of the higher voltage across first inductor 220, $I_1$ decreases more rapidly than $I_2$.

$I_1$ continues to decrease until it reaches zero at $t=t_5$. At this point, the stored energy in first inductor 220 is depleted, having been completely transferred into capacitor 270, and diode 250 ceases to conduct. However, as $I_2$ has not yet reached zero, the remaining energy in second inductor 230 continues to be transferred into capacitor 280 until $I_2$ likewise reaches zero at $t=t_6$. The preceding events are then repeated during the next switching cycle which, as previously explained, is not necessarily constrained to follow immediately after $I_2$ reaches zero.

Figure 5:
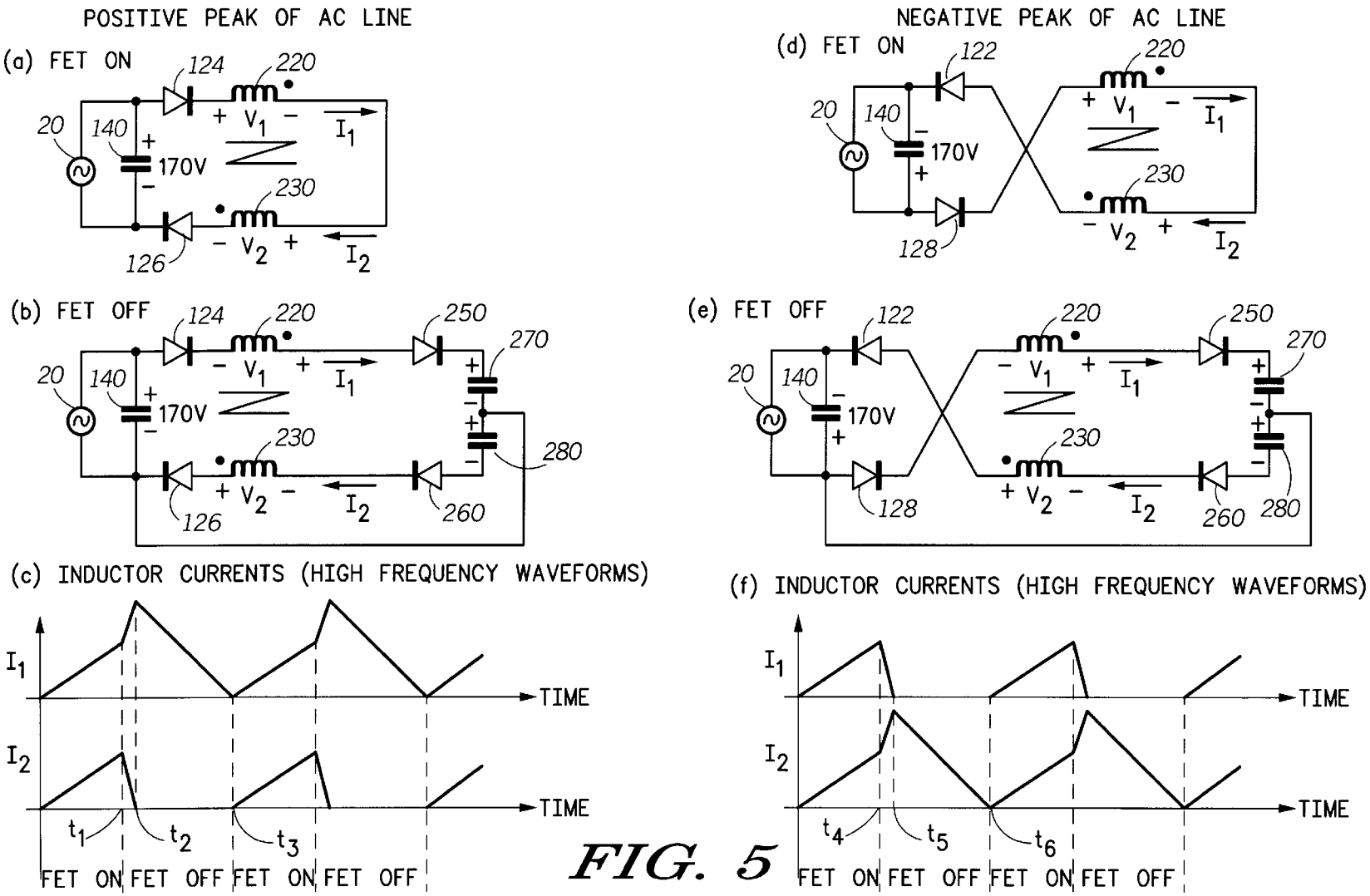
FIG. 5 illustrates equivalent circuits and approximate inductor current waveforms for the power supply of FIG. 2 when implemented with coupled inductors, in accordance with a preferred embodiment of the present invention.

FIG. 5 describes the operation of power supply 10 when inductors 220,230 are implemented as coupled inductors. As will become more apparent from the following discussion, circuit operation is somewhat different than that previously described with regard to separate inductors. Besides offering the advantage of combining inductors 220,230 into a single magnetic component, and thus reducing the physical size and material cost of voltage converter 200, it is believed that use of coupled inductors further enhances the energy efficiency of voltage converter 200 by reducing, for a given output voltage and load, the peak current that flows through FET 240, thus reducing the conduction power losses in FET 240.

During the time when the FET is on, inductors 220,230 charge up in a manner identical to that which was previously described with regard to separate inductors. When the FET is off, however, circuit operation is somewhat different from that which occurs when separate inductors are used.

Referring to FIGS. 5(*b*) and 5(*c*), which apply during positive half cycles of the AC line, when the FET turns off, diodes 250,260 become forward biased and energy is transferred from inductors 220,230 to capacitors 270,280. Additionally, due to the magnetic coupling between inductors 220,230, energy is also transferred from second inductor 230 to first inductor 220. As illustrated in FIG. 4(*c*), the transfer of energy from second inductor 230 to first inductor 220 is manifested as a continued increase in the current flowing through first inductor 220 and a corresponding decrease in the current through first inductor 220. The rate at which energy is transferred from second inductor 230 to first inductor 220 (i.e., the slope of $I_1$ during the period $t_1<t<t_2$) is a function of the leakage inductance that exists by virtue of inductors 220,230 being magnetically coupled; more specifically, a small leakage inductance increases the slope and peak value of $I_1$, while a high leakage inductance decreases the slope and peak value of $I_1$. In this way, use of coupled inductors allows a higher peak current to flow in inductor 220 without increasing the peak current and power dissipation in the FET. Thus, during positive half cycles of the AC line, a greater amount of energy is stored in first inductor 220 than in second inductor 230. Consequently, capacitor 270, which receives its energy from first inductor 220, is charged up more than capacitor 280, which receives its energy from second inductor 230. Therefore, during the positive half cycles of the AC line, capacitor 270 will have a higher voltage than capacitor 280.

During negative half cycles of the AC line, the above situation is reversed. That is, when the FET turns off, energy is magnetically transferred from first inductor 220 to second inductor 230, causing a further increase in the current $I_2$ through second inductor 230. Consequently, more energy is stored in second inductor 230 than in first inductor 220, with the result that capacitor 280 receives more energy (and, therefore, has a higher voltage) than capacitor 270 during the negative half cycles of the AC line.

Figure 6:
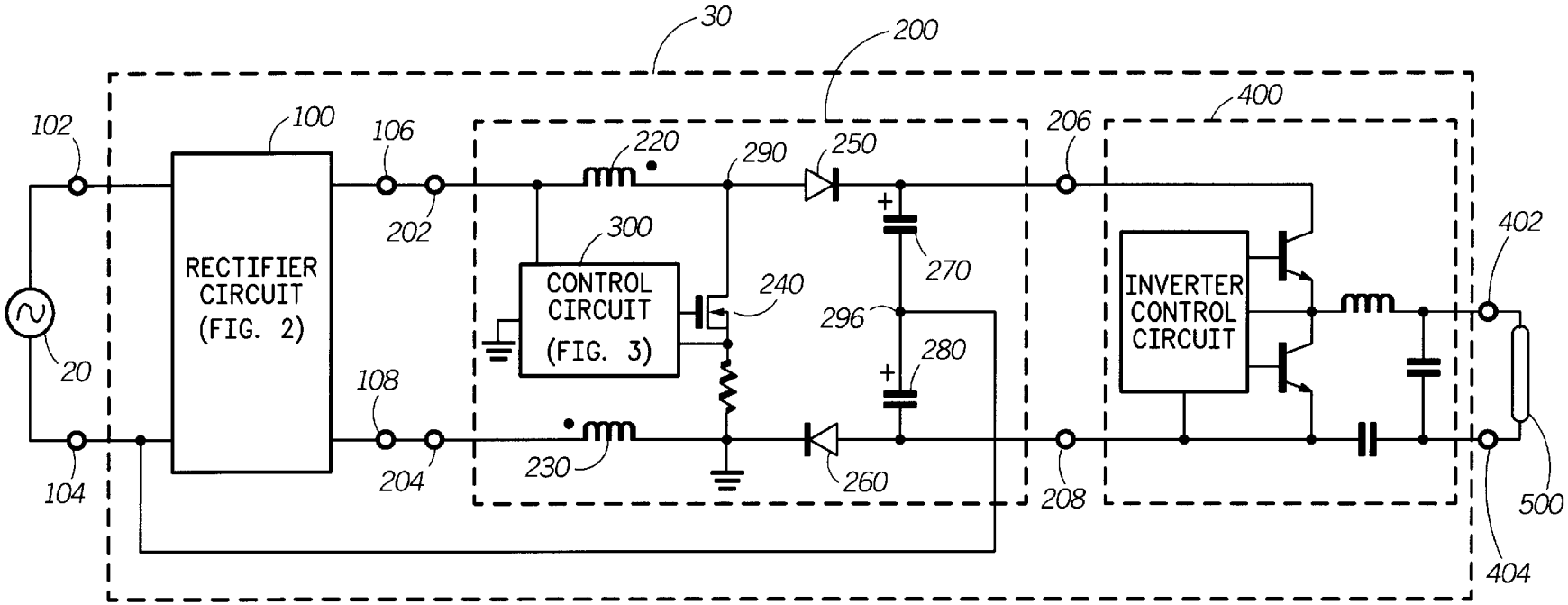
FIG. 6 is a schematic diagram of an electronic ballast for gas discharge lamps, in accordance with a preferred embodiment of the present invention.

In a preferred embodiment, as illustrated in FIG. 6, power supply 10 further comprises an inverter 400 coupled across output terminals 206,208 of voltage converter circuit 200, and is employed as an electronic ballast 30 for powering at least one gas discharge lamp 500. Inverter 400 receives the substantially direct current (DC) voltage provided by voltage converter 200, and supplies high frequency alternating current to lamp 500. Because of the high voltage provided by voltage converter 200, inverter 400 will have a lower input current and thus will operate with significantly lower power losses in various elements, such as inductor 430 and inverter transistors 410,420. Importantly, these lower power losses may allow reduction in the physical sizes and ratings of certain inverter components, thus providing further reduced cost and size, as well as enhanced ease of manufacture, for inverter 400 and electronic ballast 30.

Although the present invention has been described with reference to certain preferred embodiments, numerous modifications and variations can be made by those skilled in the art without departing from the novel spirit and scope of this invention.

What is claimed is:

1. A power supply, comprising:

a rectifier circuit having a pair of input connections adapted to receive a source of alternating current, and a pair of output connections; and a voltage converter circuit, comprising:

first and second input terminals coupled to the output connections of the rectifier circuit;

first and second output terminals;

a first inductor coupled between the first input terminal and a first node;

an electronic switch coupled between the first node and a second node;

a control circuit coupled to the electronic switch and operable to turn the electronic switch on and off;

a second inductor coupled between the second node and the second input terminal, wherein the first inductor is magnetically coupled to the second inductor, and the first inductor and the second inductor are oriented in relation to each other such that the presence of a positive voltage across the first inductor from the first input terminal to the first node substantially coincides with the presence of a positive voltage across the second inductor from the second node to the second input terminal;

a first rectifier having an anode coupled to the first node and a cathode coupled to the first output terminal;

a second rectifier having a cathode coupled to the second node and an anode coupled to the second output terminal;

a first capacitor coupled between the first output terminal and a third node, wherein the third node is coupled to one of the input connections of the rectifier circuit; and a second capacitor coupled between the third node and the second output terminal.

2. The power supply of claim 1, wherein the second inductor has an inductance that is approximately equal to that of the first inductor.

3. The power supply of claim 1, wherein the first inductor and the second inductor have an approximately equal number of turns.

4. The power supply of claim 1, wherein the first inductor and the second inductor share a common magnetic core.

5. The power supply of claim 1, wherein the electronic switch comprises a field-effect transistor having a drain lead coupled to the first node, a source lead coupled to the second node, and a gate lead coupled to the control circuit.

6. The power supply of claim 5, wherein the control circuit comprises a current-mode type controller.

7. The power supply of claim 1, wherein the rectifier circuit comprises a full-wave diode bridge coupled between the input connections and the output connections of the rectifier circuit.

8. The power supply of claim 7, wherein the rectifier circuit further comprises a high frequency bypass capacitor coupled between the input connections of the rectifier circuit.

9. The power supply of claim 1, further comprising an inverter coupled across the output terminals.

10. The power supply of claim 9, wherein the inverter is operable to power at least one gas discharge lamp.

11. A power supply, comprising:

a rectifier circuit, comprising:

a pair of input connections adapted to receive a source of alternating current;

a pair of output connections;

a full-wave diode bridge coupled between the input connections and the output connections; and a high frequency bypass capacitor coupled between the input connections of the rectifier circuit; and a voltage converter circuit, comprising:

first and second input terminals coupled to the output connections of the rectifier circuit;

first and second output terminals;

a first inductor coupled between the first input terminal and a first node;

an electronic switch coupled between the first node and a second node;

a control circuit coupled to the electronic switch and operable to turn the electronic switch on and off in a periodic manner;

a second inductor coupled between the second node and the second input terminal, wherein the second inductor has an inductance that is approximately equal to that of the first inductor, the first inductor is magnetically coupled to the second inductor, and the first inductor and the second inductor are oriented in relation to each other such that the presence of a positive voltage across the first inductor from the first input terminal to the first node substantially coincides with the presence of a positive voltage across the second inductor from the second node to the second input terminal;

a first diode having an anode coupled to the first node and a cathode coupled to the first output terminal;

a second diode having an anode coupled to the second output terminal and a cathode coupled to the second node;

a first capacitor coupled between the first output terminal and a third node, wherein the third node is coupled to one of the input connections of the rectifier circuit; and a second capacitor coupled between the third node and the second output terminal.

12. The power supply of claim 11, wherein the first inductor and the second inductor have an approximately equal number of turns.

13. The power supply of claim 11, wherein the first inductor and the second inductor share a common magnetic core.

14. The power supply of claim 11, wherein the electronic switch comprises a field-effect transistor having a drain lead coupled to the first node, a source lead coupled to the second node, and a gate lead coupled to the control circuit.

15. The power supply of claim 14, wherein the control circuit comprises a current-mode type controller.

16. The power supply of claim 11, further comprising an inverter coupled across the output terminals.

17. The power supply of claim 16, wherein the inverter is operable to power at least one gas discharge lamp.

18. An electronic ballast, comprising:

a rectifier circuit, comprising:

a pair of input connections adapted to receive a source of alternating current;

a pair of output connections;

a full-wave diode bridge coupled between the input, connections and the output connections; and a high frequency bypass capacitor coupled between the input connections of the rectifier circuit;

a voltage converter circuit, comprising:

first and second input terminals coupled to the output connections of the rectifier circuit;

first and second output terminals;

a first inductor coupled between the first input terminal and a first node; and a field-effect transistor (FET) having a drain lead coupled to the first node, a source lead coupled to a second node, and a gate lead;

a control circuit coupled to the gate of the FET and operable to turn the FET on and off at a high frequency rate;

a second inductor coupled between the second input terminal and the second node, wherein the first inductor and the second inductor are oriented in relation to each other such that the presence of a positive voltage across the first inductor from the first input terminal to the first node substantially coincides with the presence of a positive voltage across the second inductor from the second node to the second input terminal;

a first diode having an anode coupled to the first node and a cathode coupled to the first output terminal;

a second diode having a cathode coupled to the second node and an anode coupled to the second output terminal;

a first capacitor coupled between the first output terminal and a third node, wherein the third node is coupled to one of the input connections of the rectifier circuit; and a second capacitor coupled between the third node and the second output terminal; and an inverter coupled across the output terminals of the voltage converter circuit and adapted to provide operating power to at least one gas discharge lamp.

19. The power supply of claim 18, wherein the first inductor and the second inductor have an approximately equal number of turns.

20. The power supply of claim 18, wherein the second inductor is magnetically coupled to the first inductor.

21. The power supply of claim 20, wherein the first inductor and the second inductor share a common magnetic core.

* * * * *